US007958861B2

(12) United States Patent
Klumpp et al.

(10) Patent No.: US 7,958,861 B2
(45) Date of Patent: Jun. 14, 2011

(54) OIL SUMP FOR AN INTERNAL COMBUSTION ENGINE

(75) Inventors: Holger Klumpp, Mönsheim (DE); Bernhard Fackler, Rutesheim (DE); Roland Hauf, Leonberg (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 150 days.

(21) Appl. No.: 12/431,846

(22) Filed: Apr. 29, 2009

(65) Prior Publication Data

US 2010/0108019 A1 May 6, 2010

(30) Foreign Application Priority Data

Apr. 30, 2008 (DE) ..... 10 2008 022 446

(51) Int. Cl.
*F01M 1/02* (2006.01)
*F01M 9/10* (2006.01)
*F01M 11/02* (2006.01)

(52) U.S. Cl. ..... 123/196 R

(58) Field of Classification Search ..... 123/196 R, 123/196 CP; 184/106, 6.21, 6.22; *F01M 1/02, F01M 9/10, 11/02*
See application file for complete search history.

(56) References Cited

U.S. PATENT DOCUMENTS

| | | | | |
|---|---|---|---|---|
| 4,519,348 | A | 5/1985 | Hamilton | |
| 5,301,642 | A | 4/1994 | Matsushiro et al. | |
| 6,705,270 | B1 * | 3/2004 | Rau et al. | 123/195 C |
| 6,823,968 | B2 * | 11/2004 | Baeumler | 184/106 |
| 2004/0031636 | A1 | 2/2004 | Pichler et al. | |

FOREIGN PATENT DOCUMENTS

| | | | |
|---|---|---|---|
| DE | 1 927 174 | | 5/1969 |
| DE | 101 39 709 | A1 | 2/2003 |
| DE | 103 10 179 | A1 | 9/2004 |
| DE | 10 2004 043 936 | A1 | 3/2006 |
| DE | 10 2006 021 678 | A1 | 1/2008 |
| EP | 0 924 396 | A1 | 6/1999 |
| FR | 2 816 354 | A1 | 5/2002 |
| GB | 2 278 400 | A | 11/1994 |
| GB | 2 279 109 | A | 12/1994 |
| JP | 58200017 | A | 11/1983 |

* cited by examiner

*Primary Examiner* — Michael Cuff
*Assistant Examiner* — Keith Coleman
(74) *Attorney, Agent, or Firm* — RatnerPrestia

(57) ABSTRACT

An oil pan for an internal combustion engine, in which an oil suction space is formed by the arrangement of a baffle wall provided with several through-openings and at least one flap, where at least one retaining device, on which the flap is supported and/or fastened, is provided on the baffle wall, wherein several fastening openings of different cross sections are provided in the flap to attach the flap to the retaining device.

8 Claims, 3 Drawing Sheets

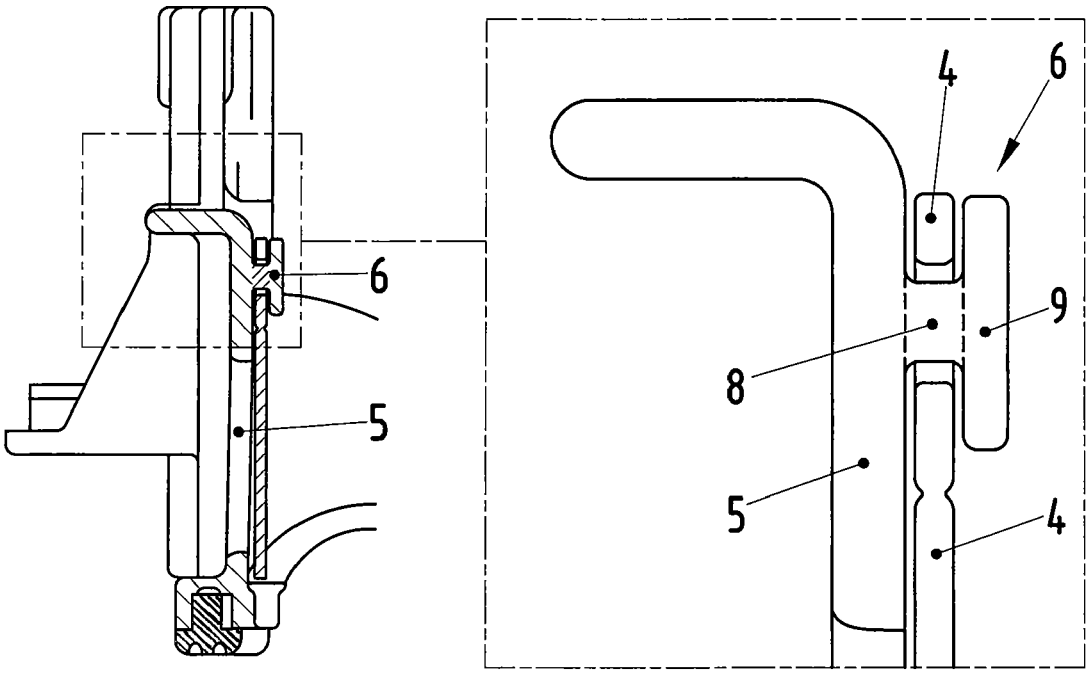
Fig. 4a
Fig. 4b
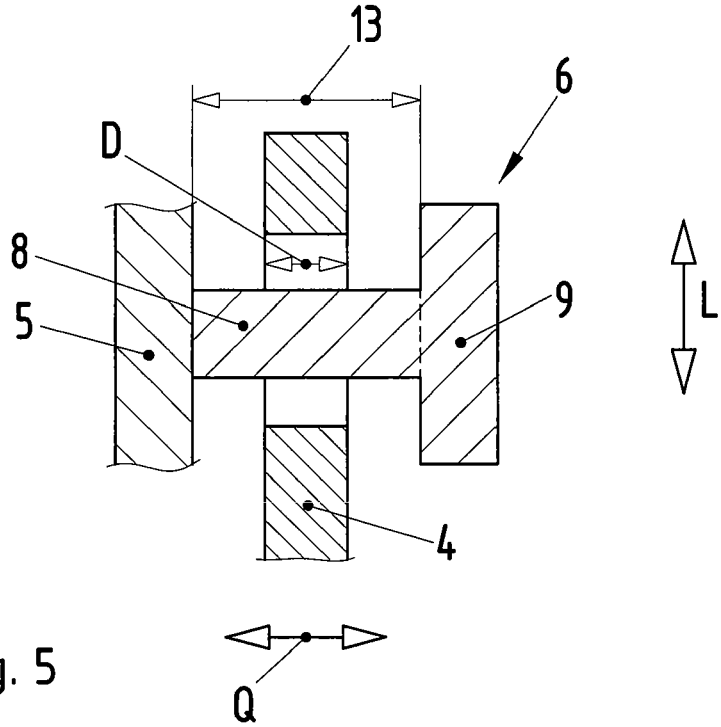
Fig. 5

OIL SUMP FOR AN INTERNAL COMBUSTION ENGINE

CROSS REFERENCE TO RELATED APPLICATIONS

This U.S. application claims priority to German Application DE 10 2008 022 446.4, filed on Apr. 30, 2008, which is incorporated by reference herein in its entirety.

FIELD OF THE INVENTION

The invention pertains to an oil pan for an internal combustion engine.

BACKGROUND OF THE INVENTION

In the operation of modern internal combustion engines, an oil baffle box, in which an oil suction space is defined, is provided inside the oil pan. The lubricating oil returned from the consumer locations within the internal combustion engine is usually sent back to areas outside the oil suction space before it passes over into the oil suction space through openings in the oil baffle box, these openings being controlled by flaps.

An oil pan into which two oil baffle walls are inserted is known from DE 101 39 709 A1. Each of the oil baffle walls is provided with two window-like through-openings, each of which is controlled by two flow flaps functioning as a nonreturn valve. Hold-down pins are provided to fasten the flow flaps to the baffle walls.

So that the baffle box inside an oil pan can fulfill its function, the flaps are usually made of elastomeric material, which expands as a result of its continuous contact with the lubricating oil. This swelling capacity means that the sealing function of such flaps is no longer guaranteed. When a swelling process such as this occurs, the flaps expand in all directions, with the result that they become bent out of shape, which impairs the sealing function of flaps of this type.

SUMMARY OF THE INVENTION

The invention relates to providing, for an internal combustion engine, an oil pan with a baffle wall in which the sealing function of the flaps mounted on the baffle wall is improved.

The inventive oil pan is characterized in that, to attach the flap to the retaining device, several fastening openings of different cross sections are provided in the flap. As a result of the different sizes of the fastening openings, an effect is produced which counteracts the expansion of the flap caused by the capacity of the flap material to swell in the lubricating oil. The flap is preferably made of an elastomeric material. Providing the fastening openings with different cross sections has the effect of compensating for play, as a result of which the flap can expand in a certain direction as a result of the swelling capacity of the elastomeric material without becoming squeezed within the retaining device or between the retaining devices. A flap subjected to squeezing of this type becomes bent out of shape, which impairs the sealing function of the flap at the through-openings.

In one embodiment of the invention, the fastening openings are arranged next to each other, where at least one centrally located fastening opening comprises a smaller cross section than the cross section of at least one of the other fastening openings; that is, the cross section of the centrally located fastening opening is smaller than the cross section of at least some of the other fastening openings. According to aspects of the present invention, the centrally located opening comprises a cross section which is approximately equivalent to the cross section of the contact area provided for it, which ensures that the flap is kept in a centered position. That is, as a result of the swelling process of the elastomeric material which occurs, expansion will occur from the central area of the flap. Therefore, bending in the horizontal direction is avoided, because the openings are larger in this horizontal direction than the cross section or thickness of the retaining device.

In another embodiment of the invention, at least one fastening opening a certain distance away from the centrally located fastening opening is designed in the form of a slot. Accordingly, the flap can expand in the transverse direction, i.e., horizontal direction, without bending. As a result, the flap remains lying against the baffle wall even after swelling has occurred.

In an advantageous embodiment of the invention, the fastening openings a certain distance away from the centrally located fastening opening are designed as slots of different lengths. With this inventive design, appropriate compensation for play in the horizontal direction can be provided in an optimized manner, so that, regardless of the tendency of the elastomeric material to swell, the sealing function of the flap inside the baffle box remains ensured.

In another embodiment of the invention, the retaining device comprises a contact section, on which the flap is supported or against which it rests, where the cross section of the fastening opening is larger than the cross section of the contact section; that is, the contact section is provided with a cross section which is smaller than the cross sections of the fastening openings. The thickness or diameter of the contact section is preferably smaller than the thickness or the smallest diameter of the fastening openings. As a result of the inventive design of the retaining device or of the fastening opening of the flaps, play is compensated appropriately whenever the flap, i.e., the elastomeric material of the flap, swells.

In one embodiment of the invention, the retaining device comprises a retaining section at the end of the contact section; the distance between this retaining section and the baffle wall is greater than the thickness of the flap. Several retaining devices are preferably provided along the baffle wall, the retaining sections of which comprise different cross sections. With this design of the retaining devices, it is ensured that the flap will rest continuously against the retaining devices during the operation of the internal combustion engine.

According to another embodiment of the invention, the retaining device and the baffle wall are designed as a one-piece unit. This makes it possible to produce the baffle wall box at low cost, especially when the baffle wall is made of plastic, so that the retaining devices can be integrated into the baffle wall.

It is obvious that the features cited above and to be explained below are applicable not only in the combinations specifically stated but also in other combinations or even alone without leaving the scope of the present invention.

BRIEF DESCRIPTION OF THE DRAWINGS

Additional features and combinations of features can be derived from the description and the attached drawings, in which a preferred embodiment of the invention is illustrated:

FIG. 4*a* shows a cross-sectional side view of a baffle wall with a retaining device, FIG. 4*b* shows a magnified view of the retaining device of FIG. 4*a*, and FIG. 5 shows a detailed view of the retaining device of FIG. 4*b*.

DETAILED DESCRIPTION OF THE DRAWINGS

Figure 1:
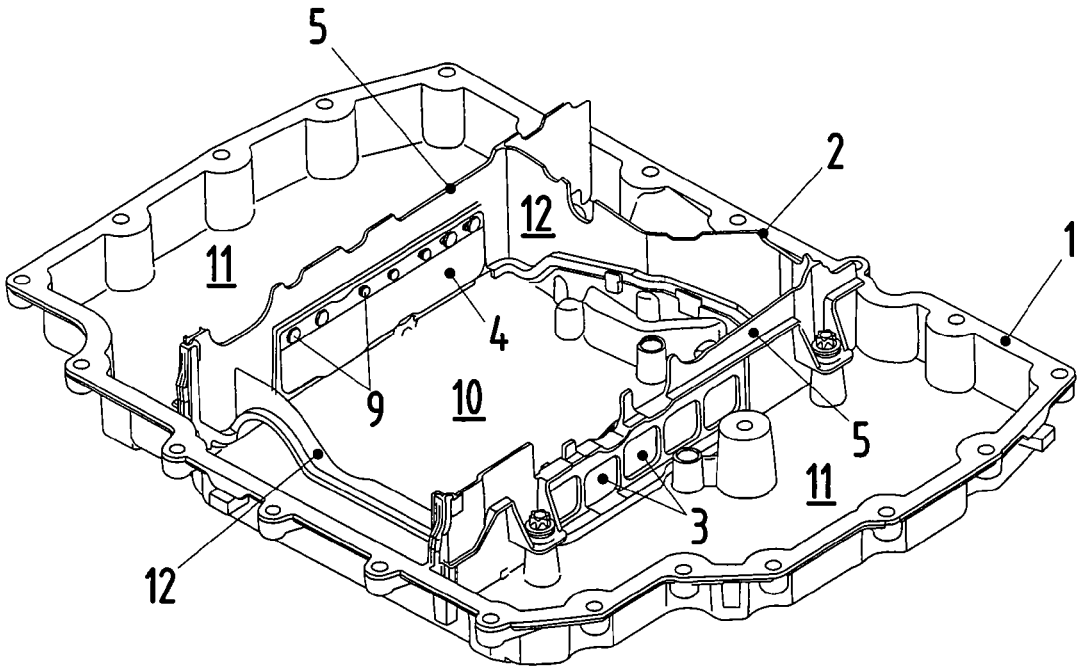
FIG. 1 shows a perspective view of an oil pan with a baffle box for an internal combustion engine.

The oil pan 1 shown in FIG. 1 is located underneath an internal combustion engine. During operation of the internal combustion engine, the lubricating oil is returned to this pan or collects in it. The lubricating oil lubricates certain consumer locations within the internal combustion engine and is supplied by an oil pump (not shown) through oil channels (not shown) to the lubrication sites. During the operation of the internal combustion engine, the lubricating oil is drawn from a central area 10 of the oil pan 1 through a suction tube (not shown) and distributed through a system of appropriate oil lines within the internal combustion engine.

In the present exemplary embodiment, a baffle box 2 is arranged inside the oil pan 1; this box divides the oil pan 1 into three areas. The lubricating oil usually flows back into the two outer edge areas or oil collection spaces 11 of the oil pan 1, where some of the lubricating oil returns there from certain areas in the cylinder head and some from areas in the crankcase. The middle area of the oil pan 1, called here the oil suction space 10, is bounded or defined by the baffle box 2. The baffle box 2 is formed by at least two baffle walls 5, which are provided with through-openings 3 and at least one flap 4. The two baffle walls 5 are connected to each other by two connecting sections 12, where the passage of the oil is controlled by the flaps 4. Thus the flaps 4 function as nonreturn valves, so that the oil can pass from an oil collection space 11 into the oil suction space 10 but not vice versa. That is, the arrangement of flaps allows the lubricating oil to flow in only one direction, so that the lubricating oil is prevented from flowing out of the oil suction space 10 into an oil collection space 11 when the vehicle is being driven around a curve, for example. As a result, there is always a sufficient amount of lubricating oil present at the oil suction tube within the baffle box 2 regardless of the state in which the internal combustion engine happens to be. The oil pump is therefore prevented from drawing in air.

The flaps 4 are preferably made of an elastomeric material, which, as a result of continuous contact with the lubricating oil, expand or tend to swell during operation of the internal combustion engine I. According to aspects of the present invention, the fastening opening 3 of the flaps 4 is provided with a special design to ensure the sealing function of the flaps 4 based on the swelling capacity of the elastomeric material. According to FIGS. 2 and 4*b*, retaining devices 6 are arranged on the baffle wall 5 to fasten the flaps 4, where the retaining device 6 is designed in the form of a stud, a plug, or a hold-down pin. According to aspects of the present invention, the retaining device 6 can be attached to the baffle wall 5 or be designed as an integral part of that wall.

Figure 3A:
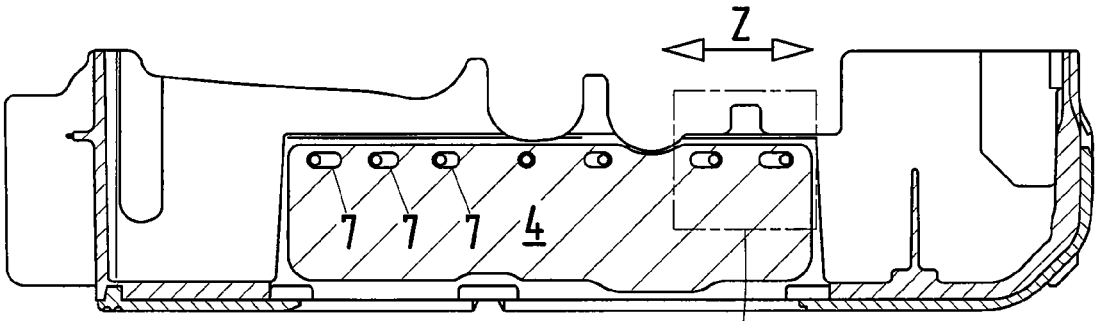
FIG. 3*a* shows a schematic diagram of a flap on a baffle wall.
Figure 3B:
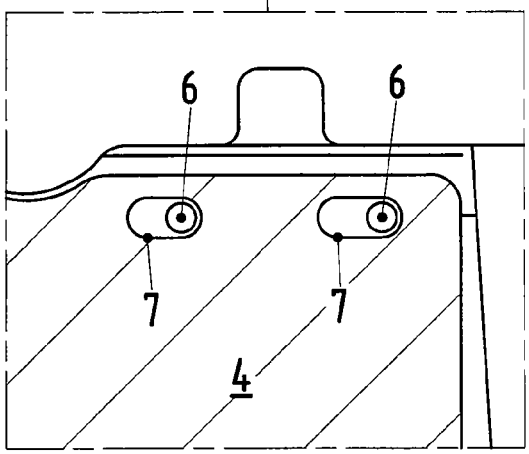
FIG. 3*b* shows a magnified view of fastening openings of the flap of FIG. 3*a*.

According to FIGS. 4*b* and 5, the retaining device 6 comprises a contact section 8 and a retaining section 9. The flap 4 is supported on the contact section 8, where, during the operation of the internal combustion engine, the flap 4 remains fastened to the retaining device 6 by the retaining section 9. As shown in FIG. 3*a*, the fastening openings 7 in the flap 4 are provided with different cross sections. The cross section of the centrally located fastening opening 7 is smaller than that of the other fastening openings 7, which ensures that the flap 4 is kept in a centered position. The different cross sections of the fastening openings 7 have the effect of compensating for play in the horizontal direction Z to counteract the swelling of the elastomeric material. That is, to prevent the flap 4 from bending in the horizontal direction Z, the openings 7 in the flap 4 are designed in such a way that they are wider in the horizontal direction Z than the cross section or thickness of the contact section 8. Accordingly, the flap 4 can expand in the horizontal direction Z without bending at the same time, where, according to aspects of the invention, the centrally located fastening opening 7 is provided with the smallest cross section, so that it can keep the flap 4 centered on the baffle wall 5.

Figure 2:
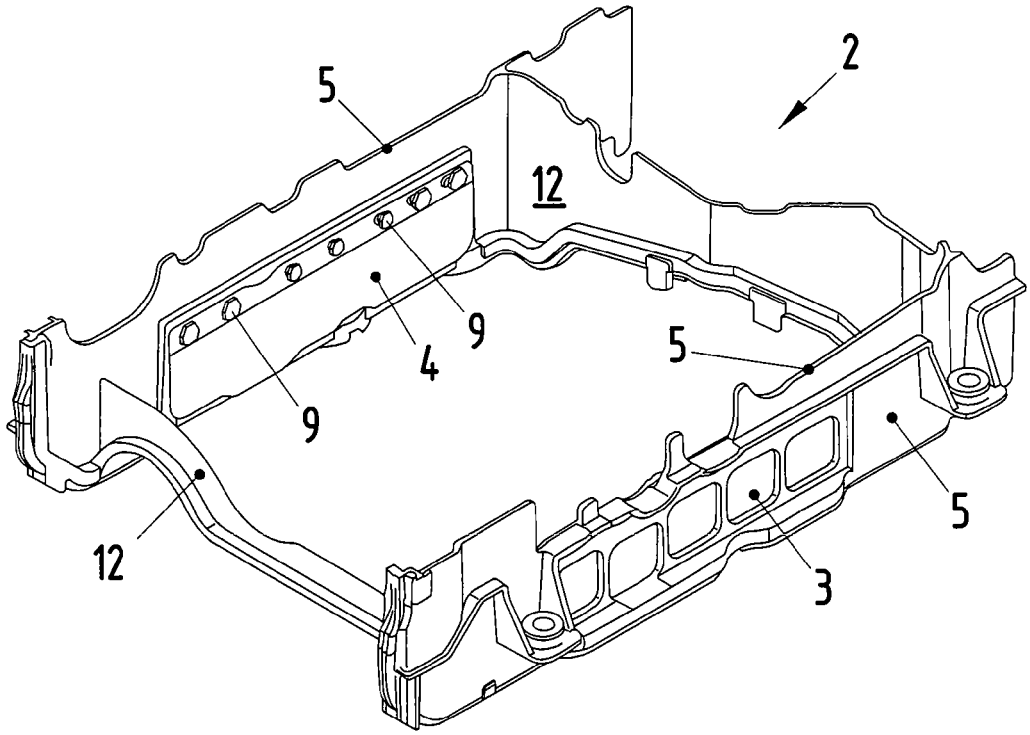
FIG. 2 shows a perspective view of the baffle box according to FIG. 1.

Because the fastening openings 7 in the flap 4 are provided with different cross sections, the retaining sections 9 are of correspondingly different sizes so that they can keep the flap 4 in position. Accordingly, larger retaining device heads 9 or correspondingly dimensioned retaining sections 9 are provided for the larger fastening openings 7. Therefore, as shown in FIG. 2, the retaining sections 9 are provided with different cross sections or different dimensions. For the centrally located fastening opening 7, the retaining section head 9 is smaller than the retaining device heads 9 a certain distance away from the center.

According to FIG. 5, furthermore, the invention also provides for compensation for play in the transverse direction Q of the retaining device 6, in which the flap 4, as a result of the swelling capacity of the elastomeric material, can expand between the baffle wall 5 and the retaining section 9 or the retaining device head 9 without becoming squeezed within the retaining device gap 13. For this purpose, the retaining device gap 13 of the retaining device 6 is larger than the thickness D of the flap 4. Compensation for play in the longitudinal direction L is achieved in that the height or diameter of the openings 7 is larger than the cross section or thickness of the contact section 8.

With the inventive design of the flap 4, appropriate compensation for play is achieved in the longitudinal direction L, in the horizontal direction Z, and in the transverse direction Q, so that, in spite of the tendency of an elastomeric material to swell, the sealing function of the flap 4 within the baffle box 2 is guaranteed. With the inventive arrangement of the baffle box 2 within the oil pan 1, the flap 4 will always produce a reliable seal against the baffle wall 5, where the one-piece design of the retaining device 6 together with the baffle wall 5 makes it possible to produce the baffle box 2 at low cost.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

The invention claimed is:

1. An oil pan for an internal combustion engine, in which an oil suction space is formed by the arrangement of a baffle wall provided with several through-openings and at least one flap, wherein at least one retaining device, on which the flap is supported and/or fastened, is provided on the baffle wall, wherein several fastening openings of different cross sections are provided in the flap to attach the flap to the retaining device, and compensate for thermal expansion of the flap.

2. An oil pan according to claim 1, wherein the fastening openings are arranged next to each other, wherein the cross section of at least one centrally located fastening opening is smaller than that of at least one of the other fastening openings.

3. An oil pan according to claim 2, wherein at least one fastening opening that is spaced from the centrally located fastening opening is designed in the form of a slot.

4. An oil pan according claim 3 further comprising a plurality of fastening openings that are spaced from the centrally located fastening opening, wherein the spaced fastening openings are slots of different lengths.

5. An oil pan according to claim 1, wherein the retaining device comprises a contact section on which the flap is supported, wherein the cross section of each fastening opening is larger than the cross section of the contact section.

6. An oil pan according to claim 1, wherein the retaining device comprises a retaining section at the end of the contact section, the distance between the retaining section and the baffle wall being greater than a thickness of the flap.

7. An oil pan according to claim 1 further comprising several retaining devices provided along the baffle wall, the retaining sections of the retaining devices comprising different cross sections.

8. An oil pan according to claim 1, wherein the retaining device is an integral part of the baffle wall.

* * * * *